US005766554A

United States Patent [19]

Liu

[11] Patent Number: 5,766,554

[45] Date of Patent: Jun. 16, 1998

[54] IMMUNOASSAY PLATES WITH DESICCANT HOUSING

[76] Inventor: Rui Ye Liu, #5 Kung Lane, Fuzhou City, Fujian Province, China, 350001

[21] Appl. No.: 684,253

[22] Filed: Jul. 19, 1996

[51] Int. Cl.[6] ..... B01L 3/00

[52] U.S. Cl. ..... 422/102; 422/68.1; 422/99; 422/101; 435/300.1; 435/301.1; 436/809

[58] Field of Search ..... 422/68.1, 99, 101, 422/102, 104; 435/300.1, 301.1; 436/809

[56] References Cited

U.S. PATENT DOCUMENTS

| | | | |
|---|---|---|---|
| Re. 28,165 | 9/1974 | McCormick | 422/102 |
| Re. 30,562 | 3/1981 | Park | 435/296 |
| Re. 34,133 | 11/1992 | Thorne | 422/99 |
| Re. 34,841 | 1/1995 | Suovaniemi et al. | 356/244 |
| 4,167,875 | 9/1979 | Meakin | 73/421 R |
| 4,735,778 | 4/1988 | Maruyama et al. | 422/102 |
| 4,770,856 | 9/1988 | Uthemann et al. | 422/104 |
| 4,889,816 | 12/1989 | Davis et al. | 436/518 |
| 4,902,481 | 2/1990 | Clark et al. | 422/101 |
| 4,990,442 | 2/1991 | Del Campo | 435/7.5 |
| 5,137,691 | 8/1992 | Parker | 422/58 |
| 5,417,923 | 5/1995 | Bojanic et al. | 422/101 |
| 5,453,897 | 9/1995 | Bakerman | 360/132 |

*Primary Examiner*—Harold Y. Pyon
*Attorney, Agent, or Firm*—Fish & Richardson P.C.

[57] ABSTRACT

A system to reduce moisture in a device having at least one integrated desiccant housing to hold desiccant materials. The integrated desiccant housing protects a desiccant bag or tablet from being damaged in the process of packaging, transporting and storing the device. In particular, an diagnostic assay tray assembly having sample wells with active biochemical coatings can be better preserved by implementing one or a plurality of integrated desiccant housing therein.

6 Claims, 4 Drawing Sheets

IMMUNOASSAY PLATES WITH DESICCANT HOUSING

FIELD OF THE INVENTION

The present invention relates to techniques for holding moisture-reducing material. More particularly, the present invention describes an improved assay tray assembly used in testing or analysis of liquids which includes a desiccant element.

BACKGROUND AND SUMMARY OF THE INVENTION

An assay tray assembly is used for detection of an analyte. Common analytes include antigens or antibodies in a liquid sample, usually of chemical, biochemical or biological nature. A variety of different kinds of assay trays are known. A typical assay tray assembly includes a tray frame and a plurality of sample wells that are either permanently molded into the frame or built in a sample unit which is removable from the tray frame. FIG. 1 shows an example of a typical assay tray assembly. A rectangular frame 100 of the assay tray has four sides 102, 104, 106, and 108. A plurality of sample wells are enclosed in the frame 100. A sample well 110 usually has a cylindrical wall and a closed end bottom plate that is preferably transparent to allow spectroscopic testing. Each sample well is coated with a chemical or biologically active substance associated with a particular analyte in a liquid sample to be tested. For example, the active coating can include antibodies or antigens. Commercial assay trays are often coated with various active materials for commonly performed tests.

The activity of a chemical or biological active substance used for coating in the sample wells is often adversely affected by moisture. Therefore, once these substances are bound to the sample wells, it has been desirable to control the humidity environment. This minimizes the denaturation and degradation thereof that may be caused by moisture in the air.

Widely adapted methods to reduce the moisture in an assay tray assembly include using a dry room for storage and sealing a coated assay tray in an air-tight package bag with water-absorbent desiccant materials. The latter is more convenient and flexible for shipping and storage. Therefore, it has been used by both research institutes and industrial sectors. The desiccant materials are usually in the form of powder or crystal packed in a bag or molded into a tablet.

A conventional method for packing the desiccant materials includes pouching the desiccant material into small desiccant bags and packing the bagged desiccants with an assay tray sealed in an air-tight package bag. This allows a desiccant bag to move around within the package. The package bag is usually designed to tightly wrap the assay tray so that the amount of material used is minimized. This is inconvenient for packaging because a separate desiccant bag has to be packed with the assay tray. Contamination of the active substances coated in the wells caused by the desiccant material occurs when the desiccant material comes into contact with the active coating substance. This happens if a desiccant bag leaks due to the compression in packaging, storing or transporting process. This proves to be problematic in preserving the quality of the coated assay trays. Moreover, additional space in the air-tight package is needed for the desiccant bags.

In recognition of the above limitations of a conventional assay tray and package for minimizing moisture, the present invention discloses an improved assay tray design. In particular, the present invention provides a secure and convenient way to minimize the moisture in an assay tray package by integrating a desiccant holding element therein.

The inventor of the present invention recognized the importance of maintaining the chemical or biological activities of coating substances in a sample well in a low moisture environment by using desiccant materials. Importantly, the inventor recognized that physical contact between the desiccant materials and the coating substances in a sample well can induce undesired biochemical reactions therebetween and thereby contaminate the coating substances. The inventor further recognized that the separation between the desiccant materials and sample wells in an assay tray should be maintained under normal storage and transportation conditions.

In view of these recognitions, the present invention describes an assay tray with at least one integrated desiccant holder. The desiccant holder is built into the tray assembly and has surfaces that securely retain either a desiccant tablet or a pack of powder desiccant materials therein. An opening of the desiccant holder allows desiccant materials therein to absorb moisture from the air in the assay tray assembly.

The present invention provides important improvements in the conventional assay tray design and moisture protection known to the art. The desiccant materials are securely held within the integrated desiccant wells so that they do not move around within a packaged assay tray. This provides convenience and ease in packaging and reduces the amount of packaging materials used in the air-tight packing bags. The desiccant material is held within the desiccant well that is made of a rigid plastic material. There is preferably no contact between the packaging bag and the desiccant and hence damage to a desiccant tablet or powder pack in packing process, storage and transportation is minimized. This further minimizes the possibility that the desiccant material is in physical contact with the coating substance inside sample wells and therefore the deleterious effects in the coating substances due to their biochemical reactions with desiccant materials are minimized. Moreover, the present invention includes structure allowing replacement of desiccant materials as their moisture-absorbing capability decays after some time of use.

DETAILED DESCRIPTION OF THE INVENTION

Figure 1:
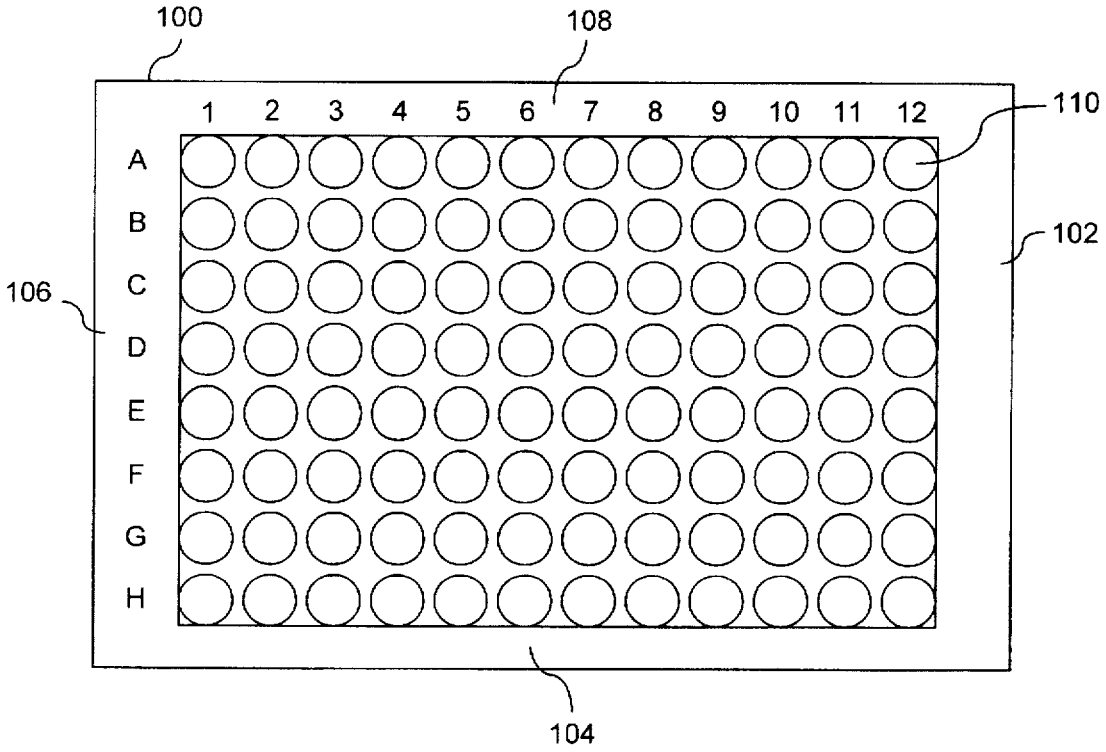
FIG. 1 shows a conventional assay tray known to the art.
Figure 2A:
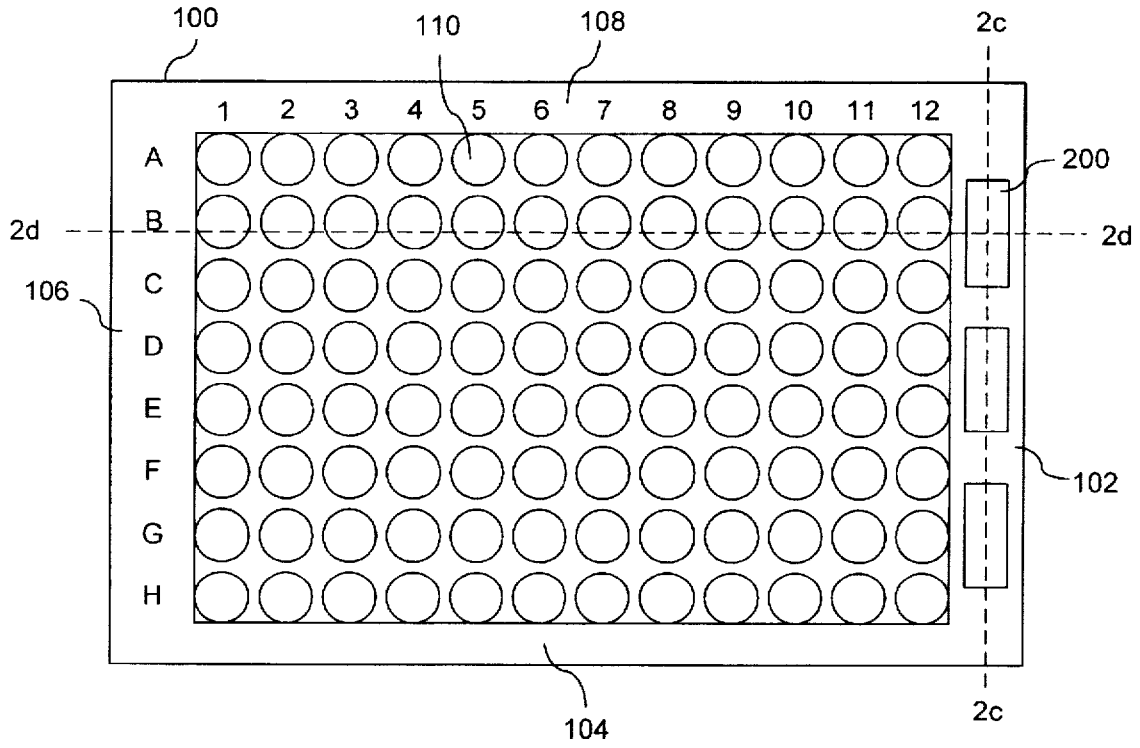
FIG. 2*a* shows the preferred embodiment of the improved assay tray of the present invention.

FIG. 2*a* is a schematic which illustrates one preferred embodiment of the present invention. At least one desiccant well 200 is included in the tray frame 100 of an assay tray as shown in the top plane view. The desiccant well 200 has a shape that is designed to hold a disk-shaped desiccant tablet. The desiccant well 200 is preferably located in such a position in the assay tray that it will neither affect the assay tray assembly in a testing procedure nor obscure the labels of sample wells often marked on the tray frame.

Figure 2B:
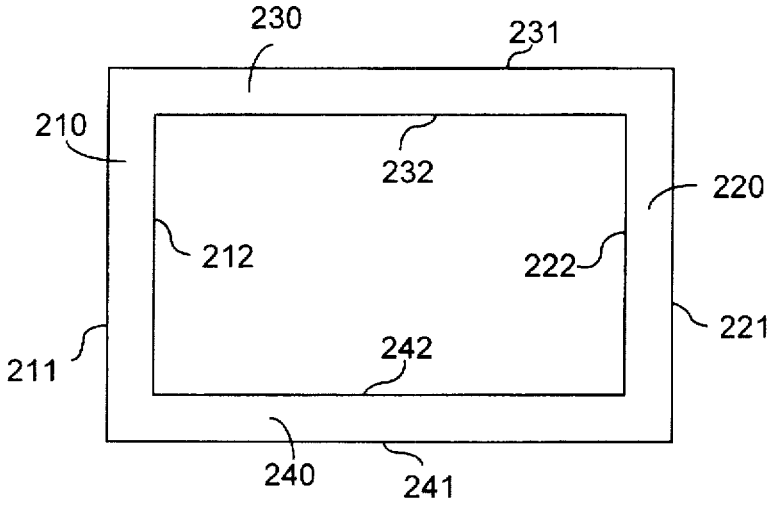
FIG. 2*b* shows the top view of the top opening of a first preferred embodiment of the desiccant well 200 shown in FIG. 2*a*.
Figure 2C:
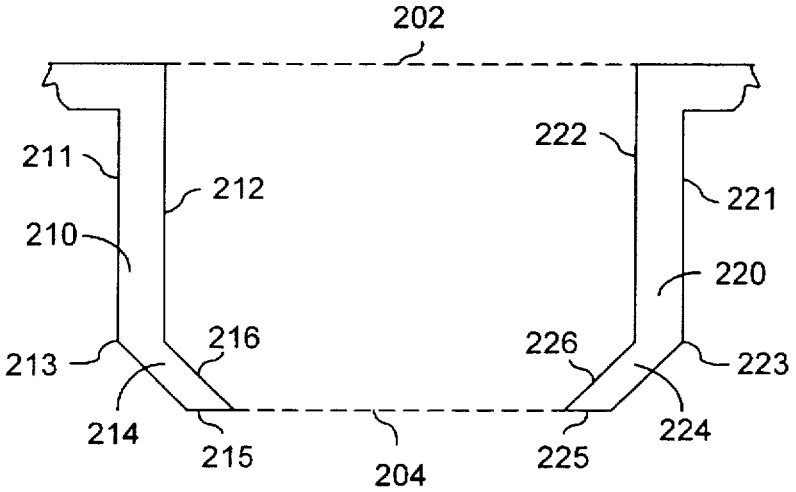
FIG. 2*c* shows the sectional view of the first embodiment of the desiccant well 200 along the line 2*c*—2*c* in FIG. 2*a*.
Figure 2D:
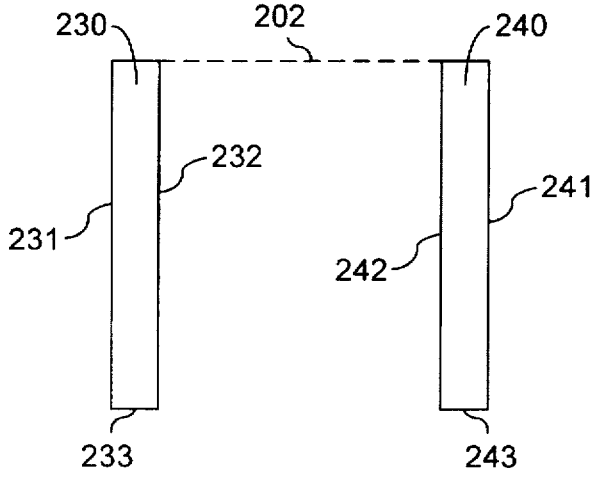
FIG. 2*d* shows the sectional view of the first embodiment of the desiccant well 200 along the line 2*d*—2*d* in FIG. 2*a*.

The first embodiment of the desiccant well 200 is shown in FIGS. 2*b*, 2*c*, and 2*d*. A top view of the top opening of the desiccant well 200 is shown in FIG. 2*b*. FIG. 2*c* shows the sectional view of the first embodiment of the desiccant well 200 along the line 2*c*—2*c* in FIG. 2*a* and FIG. 2*d* shows the sectional view of the first embodiment thereof along the line 2*d*—2*d* in FIG. 2*a*, respectively. The desiccant well 200 has a rectangular top opening 202, four side walls 210, 220, 230, and 240, and a bottom opening 204. Each side wall has an inner surface within the desiccant well 200 and an outer surface. Each side wall 210, 220, 230 and 240 includes inner surface 212, 222, 232, and 242, respectively. The outer surface of side wall 210, 220, 230, and 240 includes 211, 221, 231, and 241, respectively. The side walls 210 and 220 oppose each other to form a first pair of holding surfaces and are shaped to hold a first part of a desiccant tablet with their inner surfaces 212 and 222, respectively. The side walls 230 and 240 oppose each other to form a second pair of holding surfaces and are shaped to hold a second part of the desiccant tablet with their inner surfaces 232 and 242, respectively.

All four side walls are attached to the top surface 201 of the frame 100 to form the top opening 202 of the desiccant well 200. The bottom part 213 of the wall 210 extends to form a first bent structure 214. The bottom part 223 of the wall 220 extends to form a second bent structure 224 facing the first bent structure 214. Both bent structures 214 and 224 bend symmetrically with an inner surface 216 of the bent structure 214 and an inner surface 226 of the bent structure 224 facing each other. The inner surface 216 forms a first obtuse angle with respect to the inner surface 212 and the inner surface 226 forms a second obtuse angle with respect to the inner surface 222, respectively. The first obtuse angle is substantially identical to the second obtuse angle. The bottom opening 206 is formed with the two bent structures 214 and 224, the bottom ends 233 and 243 of side walls 230 and 240. The bottom opening 204 is smaller than the top opening 205 due to the presence of the bent structures 214 and 224. The bent structures 214 and 224 function to form a third pair of holding surfaces to the desiccant tablet in a third way with inner surfaces 216 and 226 thereof.

The thickness of a desiccant tablet to be used with the assay tray assembly in FIGS. 2*a* and 2*b* is slightly less than the spacing between the inner surfaces 232 and 242 of the opposing side walls 230 and 240. The diameter of the desiccant tablet is approximately equal to the spacing between the inner surfaces 212 and 222 of the opposing side walls 203 and 204. The depth of the well 200, i.e., the spacing between the top opening 202 and the bottom opening 204, is larger than the diameter of the desiccant tablet.

In operation, the desiccant tablet is inserted into the desiccant well 200 with its both circular surfaces parallel to the opposing side walls 230 and 240 from the top opening 202. The inner surfaces 212 and 222 of the opposing side walls 210 and 220 may exert a compressive force on the inserted desiccant tablet in the desiccant well 200 to secure the tablet therewithin.

Both the top opening 202 and the bottom opening 204 function as air conduit from the desiccant well 200 to the sample wells in the assay tray packaged in an air-tight packing bag and facilitate the inserted desiccant tablet to absorb moisture from the environment of the coated sample wells thereof. This allows maintaining a low moisture condition inside the assay tray. Being entirely hidden in the desiccant well 200, the desiccant tablet is protected by the tray frame 100 and the desiccant well 200. This avoids damage to the desiccant tablet during packaging, transporting, and storage. Moreover, the desiccant well 200 physically separates the desiccant tablet from the sample wells that are coated with active substances. This way, the possibility of the desiccant material physically contacting the coated substances is reduced. Therefore, adverse effects on the biochemical activity of the coated substances due to reactions between the desiccant and the coated substances are significantly reduced.

Another important feature of the desiccant well 200 is that a desiccant tablet therein can be conveniently replaced. A desiccant tablet can be taken out of the desiccant well 200 by pushing the tablet from the bottom opening 204.

Furthermore, the present invention reduces the amount of material used for making the air-tight packaging bag since the desiccant tablets are entirely hidden inside the tray frame 100 of an assay tray assembly.

Multiple desiccant wells 200 can be built in the tray frame 100 to increase the moisture absorbing capability of an assay tray assembly. Three desiccant wells are shown in FIG. 2.

The desiccant well 200 can be made in many shapes and dimensions other than the rectangular shape as described thereabove. This allows a desiccant tablet to be molded into various convenient shapes (e.g., a cylindrical shape, a cubic or a rectangular block).

In addition, desiccant bags or packages of various shapes and dimensions can be used in the present invention instead of molded desiccant tablets.

According to the present invention, there are several advantages to have an opened bottom 204 in the desiccant well 200 over a closed bottom. First, the opened bottom 204 provides air conduit from the desiccant well 200 to the environment of coated sample wells in addition to the top opening 202. Secondly, it allows easy replacement of a desiccant tablet. Thirdly, it facilitates the standard manufacturing process since most commercial assay trays are made with molding method.

Figure 3:
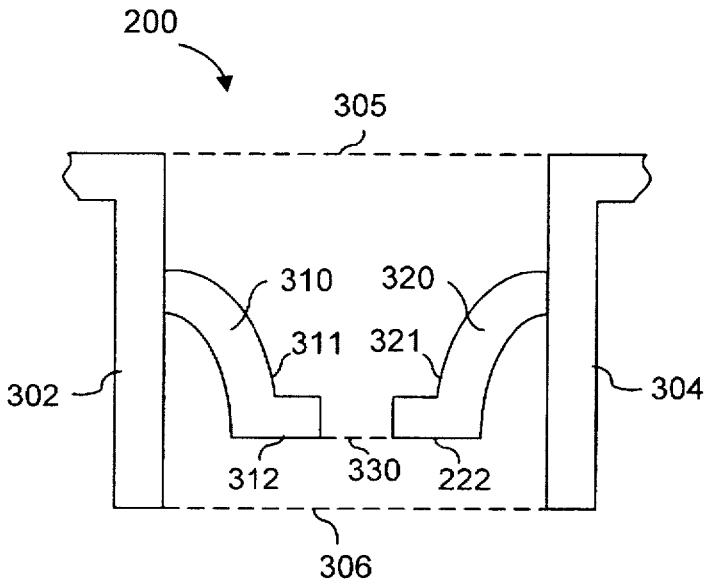
FIG. 3 shows the sectional view of a second embodiment of the desiccant well 200 along the line 2*e*—2*e* in FIG. 2*a*.

FIG. 3 illustrates a second embodiment of the desiccant well 200 along the line 2*d*—2*d* in FIG. 2*a*. The desiccant well 200 include a rectangular top opening 305, a rectangular bottom opening 306, four side walls, and two holding arms 310 and 320 for securing a desiccant tablet or a desiccant bag within the well 200.

The first holding arm 310 is attached to a first side wall 302 of the desiccant well 200. A second holding arm 320 is attached to a second side wall 304 opposing the first side wall 302. Both holding arms 310 and 320 are shaped in arc and are curved away from each other. The bottom portion 311 of the first holding arm 310 is preferably parallel to the side wall 302 and extends to a first bottom extension 312 perpendicular to the bottom portion 311 thereof. Similarly, the bottom portion 321 of the second holding arm 320 is preferably parallel to the side wall 302 and extends to a second bottom extension 322 perpendicular to the bottom portion 321 thereof. The holding arms 310 and 320 are shaped and sized so that an opening 330 is maintained between the first bottom extension 312 and the second bottom extension 322.

The first holding arm 310 and the second holding arm 320 respectively have two holding surfaces opposing each other to hold a desiccant tablet or bag in a first way. The top surfaces of the first bottom extension 312 and the second bottom extension 322 hold a desiccant tablet or bag in a second way. The opening 330 is sized to be smaller than the dimension of a desiccant tablet or desiccant bag.

In operation, a desiccant tablet or desiccant bag of a predetermined dimension is inserted between the two arms 310 and 320 from the top opening 305. The two holding arms 310 and 320 exert compression force to secure the desiccant material inside the desiccant well 200. The four side walls such as 302 and 304 are made of rigid plastic material to protect the desiccant material therein. The top opening 305 of the desiccant well 200, the opening 330 and the bottom opening 306 provide air conduits to the surrounding of the coated sample wells in the assay tray.

The opening 330 and the bottom opening 306 also allow easy replacement of a desiccant tablet or bag. In addition, they also facilitate the molding process in manufacturing the assay tray that is widely used in commercial production.

The desiccant well 200 can have various shapes and dimensions. Some examples include square, rectangle, and circular.

A plurality of desiccant wells similar to the desiccant well 200 are implied by the present invention. One advantage of using multiple desiccant wells is an increased moisture-absorbing capability of the assay tray assembly.

Although the present invention has been described in detail with reference to a number of particular embodiments, one ordinarily skilled in the art to which this invention pertains will appreciate that various modifications and enhancements may be made without departing from the spirit and scope of the present invention. For example, the desiccant well of the present invention can be implemented in many other devices that require a low moisture environment. The integrated desiccant well prevents a desiccant tablet or bag from crashing and squeezing caused by the external compression and provides a convenient way to reduce the moisture level. Importantly, a desiccant well should be implemented so that the functionability of a device is not adversely affected.

All these and other modifications are intended to be encompassed within the following claims.

What is claimed is:

1. A sample holding device including a moisture-reducing element, comprising:

a sample holding area having a plurality of sample wells configured to hold samples;

at least one desiccant-holding well defined by a perimeter surrounding said sample holding area and separated from said sample wells, said desiccant-holding well configured to have a plurality of surfaces that define first and second openings at opposing ends, each of said openings extending through said perimeter, said desiccant-holding well designated to hold an amount of desiccant material; and at least one air conduit, connecting said desiccant-holding well to said sample holding area;

wherein said desiccant-holding well and said desiccant material are operable to reduce moisture from said sample holding area.

2. A device as in claim 1, wherein said air conduit includes at least one of said first and second openings in said desiccant-holding well.

3. A device as in claim 1, wherein said plurality of surfaces of said desiccant-holding well include a first surface having a top flat portion and a bottom bent portion which forms an obtuse angle with respect to said top flat portion; a second surface being substantially identical to and opposing said first surface, said second surface being arranged relative to said first surface such that said bottom bent portions thereof bend towards to each other and maintain a gap therebetween; a third flat surface disposed between said first and second surfaces; and a fourth flat surface opposing said third surface and disposed between said first and second surface;

wherein said first surface, said second surface, said third surface, and said fourth surface form said first opening and said second opening smaller than said first opening.

4. A device as in claim 1, further including:

a first wall in said desiccant-holding well;

a second wall in said desiccant-holding well opposing said first wall;

a first holding arm attached to said first wall and configured to have a first arc portion and a first bottom extension that is connected to and perpendicular to a bottom portion of said first arc portion; and a second holding arm substantially similar to said first holding arm and having a second arc portion and a second bottom extension that is connected to and perpendicular to a bottom portion of said second arc portion, said first bottom extension and said second bottom extension forming a spatial gap therebetween which is smaller than said first and second openings of said desiccant well;

wherein said first and second holding arms form a desiccant holder operable to hold said amount of desiccant material.

5. A sample holding device including a moisture-reducing element, comprising:

a sample holding area having a plurality of sample wells configured to hold samples;

at least one desiccant-holding well defined by a perimeter surrounding said sample holding area and separated from said sample wells, said desiccant-holding well having a top opening and a plurality of supporting surfaces and being designated to hold an amount of desiccant material, wherein said plurality of supporting surfaces include a first surface having a top flat portion and a bottom bent portion which forms an obtuse angle with respect to said top flat portion; a second surface being substantially identical to and opposing said first surface, said second surface being arranged relative to said first surface such that said bottom bent portions thereof bend towards to each other and maintain a gap therebetween; a third flat surface disposed between said first and second surfaces; and a fourth flat surface opposing said third surface and disposed between said first and second surface; and at least one air conduit, connecting said desiccant-holding well to said sample holding area;

wherein said first surface, said second surface, said third surface, and said fourth surface form a rectangular topped opening and a bottom opening which is smaller than said top opening and said desiccant-holding well and said desiccant material are operable to reduce moisture from said sample holding area.

6. A sample holding device including a moisture-reducing element, comprising:

a sample holding area having a plurality of sample wells configured to hold samples;

at least one desiccant-holding well defined by a perimeter surrounding said sample holding area and separated from said sample wells, said desiccant-holding well configured to have a top opening and designated to hold an amount of desiccant material;

a first wall in said desiccant-holding well;

a second wall in said desiccant-holding well opposing said first wall;

a first holding arm attached to said first wall and configured to have a first arc portion and a first bottom extension that is connected to and perpendicular to a bottom portion of said first arc portion;

a second holding arm substantially similar to said first holding arm and having a second arc portion and a second bottom extension that is connected to and perpendicular to a bottom portion of said second arc portion, said first bottom extension and said second bottom extension forming a spatial gap therebetween which is smaller than said top opening, wherein said first and second holding arms construct a desiccant holder to hold said amount of desiccant material; and at least one air conduit, connecting said desiccant-holding well to said sample holding area.

* * * * *